US008293691B2

(12) United States Patent
Mulder et al.

(10) Patent No.: US 8,293,691 B2
(45) Date of Patent: Oct. 23, 2012

(54) METAL PROCESSING LUBRICANT COMPOSITION

(75) Inventors: Hendrik L. Mulder, Mijdrecht (NL); Jan Baptist Andreas Felix Smeulders, Amsterdam (NL); Robert A. Herrendorf, Voorhout (NL)

(73) Assignee: Quaker Chemical Corporation, Conshohocken, PA (US)

( * ) Notice: Subject to any disclaimer, the term of this patent is extended or adjusted under 35 U.S.C. 154(b) by 466 days.

(21) Appl. No.: 12/312,419

(22) PCT Filed: Nov. 8, 2007

(86) PCT No.: PCT/NL2007/050546
§ 371 (c)(1),
(2), (4) Date: Feb. 20, 2010

(87) PCT Pub. No.: WO2008/056981
PCT Pub. Date: May 15, 2008

(65) Prior Publication Data

US 2010/0160199 A1 Jun. 24, 2010

(30) Foreign Application Priority Data

Nov. 10, 2006 (EP) ..... 06123843

(51) Int. Cl.
*C07C 69/34* (2006.01)
*C10M 105/38* (2006.01)

(52) U.S. Cl. ..... 508/485; 508/465

(58) Field of Classification Search ..... 508/465, 508/485
See application file for complete search history.

(56) References Cited

U.S. PATENT DOCUMENTS

| | | | | |
|---|---|---|---|---|
| 3,526,596 | A | 9/1970 | Kress et al. | |
| 4,178,260 | A | 12/1979 | Cook et al. | |
| 4,362,634 | A | 12/1982 | Berens et al. | |
| 4,530,772 | A | 7/1985 | Timony | |
| 5,761,941 | A * | 6/1998 | Matsui et al. | 72/42 |
| 6,462,001 | B1 * | 10/2002 | Kenbeek et al. | 508/492 |
| 2004/0116308 | A1 | 6/2004 | Yokota et al. | |

FOREIGN PATENT DOCUMENTS

| | | |
|---|---|---|
| EP | 1529828 A1 | 11/2005 |
| JP | 3134094 | 6/1991 |
| JP | 6033082 | 2/1994 |
| JP | 10292187 | 11/1998 |
| JP | 2000073079 | 3/2000 |
| WO | 2008056981 | 5/2008 |

OTHER PUBLICATIONS

Klamann D: "Lubricants and Related Products" 1984, Lubricants and Related Products, Synthesis, Properties, Applications, International Standards, Weinheim, Verlag Chemie, DE, pp. 130-133, XP002319849, Figure 78; Table 49.
International Search Report dated Jul. 10, 2008, 5 pages.

* cited by examiner

*Primary Examiner* — Walter D Griffin
*Assistant Examiner* — Francis C Campanell
(74) *Attorney, Agent, or Firm* — Morgan, Lewis & Bockius LLP

(57) ABSTRACT

The present invention relates to metal processing lubricant compositions that are based on polyhydrocarbyl esters of aliphatic polyols, in particular tetrahydrocarbyl esters of pentaerythritol, wherein at least one hydrocarbyl group of the tetrahydrocarbyl ester comprises 6-14 carbon atoms and the other hydrocarbyl groups comprise 6-20 carbon atoms. The compositions are in particular suitable for metal forming operations, e.g. a cold rolling operation, a hot rolling operation or a drawing operation, and metal removing operations, e.g. grinding, milling, cutting, turning and honing.

19 Claims, No Drawings

METAL PROCESSING LUBRICANT COMPOSITION

STATEMENT OF RELATED APPLICATIONS

This application is the U.S. National Stage Entry of International Application No. PCT/NL2007/050546, filed Nov. 8, 2007, which in turn claims the benefit of European Patent Application No. 06123843.2, filed Nov. 10, 2006, each of which is incorporated herein by reference in its entirety.

FIELD OF THE INVENTION

The present invention relates to metal processing lubricant compositions that are based on particular polyhydrocarbylesters of aliphatic polyols, in particular tetrahydrocarbyl esters of pentaerythritol, wherein at least one hydrocarbyl group of the polyhydrocarbyl ester and of the tetrahydrocarbyl ester comprises 6-14 carbon atoms and the other hydrocarbyl groups comprise 6-20 carbon atoms.

BACKGROUND OF THE INVENTION

Tetrahydrocarbyl esters of pentaerythritol are known in the art and are for example used as lubricant component in e.g. turbine oils and compressor lubricants.

U.S. Pat. No. 3,526,596 of Quaker Chemical Corporation, incorporated by reference, discloses a lubricant for to be used at very high temperatures in the process of shaping and working metals while they are heated to temperatures at which they are malleable such as hot rolling. The metal can be steel, copper, brass, aluminum, magnesium and titanium. According to a preferred embodiment, the lubricant is a pentaerythritol ester of $C_{12}$-$C_{22}$ fatty acids. Example 2 of U.S. Pat. No. 3,526,596 discloses the tetrahydrocarbyl ester obtained from reacting oleic acid (9-octadecenoic acid) and pentaerythritol.

U.S. Pat. No. 4,178,260 of Exxon Research & Engineering Co., incorporated by reference herein, discloses lubricants for hot and cold rolling of steel and aluminum and for casting of metals, in particular aluminum. The lubricants are said to have improved roll anti-wear and friction properties. The preferred lubricants are a mixture of (i) the tetrahydrocarbyl esters of pentaerythritol and $C_{16}$-$C_{20}$ aliphatic monocarboxylic acids and (ii) orthophosphoric acid. Example 5 discloses pentaerythritol tetracaproate (the tetrahydrocarbyl ester of pentaerythritol and hexanoic acid; it is not explicitly disclosed that caproic acid is n-hexanoic acid) and compared to pentaerythritol tetraoleate, it shows a higher coefficient of friction thereby teaching the person skilled in the art that the tetrahydrocarbyl ester of pentaerythritol and caproic acid is less suitable for rolling and casting applications.

U.S. Pat. No. 4,362,634 of Stauffer Chemical Company, incorporated by reference herein, discloses metal working lubricants comprising about 60 to about 90 weight percent of a polyol ester derived from the esterification of an aliphatic polyol with an aliphatic carboxylic acid. The polyol has 3 to 15 carbon atoms and 3 to 8 hydroxy groups and is preferably trimethylolpropane, pentaerythritol, dipentaerythritol, tripentaerythritol and mixtures thereof. The carboxylic acid is selected from the group consisting of aliphatic monocarboxylic acids and mixtures of aliphatic monocarboxylic acids and aliphatic dicarboxylic acids. The aliphatic monocarboxylic acid contains 4 to 18 carbon atoms and suitable examples include hexanoic acid, heptanoic acid, nonanoic acid and mixtures thereof. A mixture of aliphatic monocarboxylic acids and aliphatic dicarboxylic acids is used when increased viscosities are desired. The example discloses Basestock 810™ which according to U.S. Pat. No. 4,530,772 is a pentaerythritol ester of $C_7$ acid crosslinked with azelaic acid.

U.S. Pat. No. 5,761,941 of Kabushiki Kaisha Kobe Seiko Sho. and Kao Corporation discloses a lubricant composition for press-forming an aluminum or aluminum alloy sheet comprising a hydrocarbon and a $C_{10}$-$C_{24}$ linear of branched fatty alcohol. The lubricant composition may further comprise a component (c), said component (c) being selected from the group consisting of (1) oils and fats, (2) esters of a polyol and a $C_{12}$-$C_{24}$ fatty acid and (3) esters having a $M_w$ of 750 to 7500 which are obtained by reacting a $C_{12}$-$C_{24}$ alcohol or a $C_{12}$-$C_{24}$ fatty acid with residual carboxy groups or hydroxy groups, respectively, of an ester of a dimeric acid or polymeric acid of a $C_{16}$-$C_{20}$ fatty acid and a polyol. Example 1 discloses an Ester E which is a tetra-ester of pentaerythritol and hydrogenated coconut oil fatty acid which consists for the major part of $C_{12}$-$C_{18}$ acids and an ester D which is obtained by condensing an ester of dimeric oleic acid and ethylene glycol with stearyl alcohol.

US 2004/0116308 of Nippon Mitsubishi Oil Corp. discloses oils for cutting and grinding comprising an ester which may be derived from monohydric or polyhydric alcohols and monobasic and polybasic acids. Preferred are esters from polyhydric alcohols and monobasic acids, e.g. the triester of neopentyl glycol and oleic acid, the triester of trimethylolpropane and oleic acid, the tetraester of trimethylolpropane and a mixture of n-hexanoic acid, n-octanoic acid and n-decanoic acid (molar ratio of 7;59;34) and the tetraester of pentaerythritol and n-octanoic acid.

JP 2000073079 discloses a metal working fluid comprising a triester of glycerol and $C_8$-$C_{12}$ acids.

U.S. Pat. No. 6,462,001 of Unichema discloses complex esters which may be used for metal working and metal rolling applications. The complex esters are made by condensing polyfunctional alcohols, polyfunctional acids and a chain stopper, the chain stopper being either a mono fatty acid or a mono fatty alcohol.

EP 1.529.828 of Malaysian Palm Oil Board discloses the tetraester of pentaerythritol and caprylic acid and the tetraester of capric acid.

JP A 4117494, JP A 4117495 and JP A 4118101 of Nihon Kueeka Kemikaru KK, incorporated by reference herein, disclose a rolling oil additive comprising a lubricating component, e.g. a polyhydric alcohol ester of a higher fatty acid, which has a viscosity of 80 cSt or more at 40° C.

RU 2.163.625 C2, incorporated by reference herein, discloses a lubricant for hot rolling comprising an ester of "pentaerythrite" (this term is an equivalent of pentaerythritol) and synthetic $C_5$-$C_9$ fatty acids. However, the structure of either the esters or the fatty acids is not disclosed.

WO 2005/017078 of ICI, Ltd., relates to a water soluble rolling oil composition for use in cold steel rolling applications comprising a partial polyol ester having a OH-value of 20-50 mg KOH/g and a level of unsaturation of 0.01-8% by weight. The partial polyol ester is derived from the reaction between a polyhydric alcohol, e.g. pentaerythritol, and monocarboxylic acids, wherein part of these monocarboxylic acids is unsaturated. Tetrahydrocarbyl esters of pentaerythritol are, however, not disclosed.

It is generally known that metal processing lubricant compositions have to meet many requirements including good friction properties over a wide range of film thicknesses, good compatibility with other lubricating additives, excellent compatibility with aqueous systems, good evaporation and annealing characteristics, a high corrosive and oxidation stability, in particular at elevated temperatures, a relatively low pour point, low foam formation, iron fines handling, sheet- and mill cleanliness and the like: see for example U.S. Pat. No. 4,746,448, U.S. Pat. No. 4,885,104 and U.S. Pat. No. 4,889,648, all incorporated by reference. Although many metal processing lubricant compositions are disclosed in the prior art and are even commercialized, there remains a need within the art to provide metal processing lubricant compositions that meet those performance requirements in an improved manner and that are applicable under a wide range of operating conditions.

SUMMARY OF THE INVENTION

The present invention relates to a metal processing lubricant composition comprising a metal processing lubricant composition comprising a polyhydrocarbyl ester of an aliphatic polyol, wherein at least one hydrocarbyl group of the polyhydrocarbyl ester comprises 6-14 carbon atoms and wherein the aliphatic polyol comprises 2-12 OH groups, and to the use of a polyhydrocarbyl ester of an aliphatic polyol in metal processing operations, wherein at least one hydrocarbyl group of the polyhydrocarbyl ester comprises 6-14 carbon atoms and wherein the aliphatic polyol comprises 2-12 OH groups.

DETAILED DESCRIPTION OF THE INVENTION

The verb "to comprise" as is used in this description and in the claims and its conjugations is used in its non-limiting sense to mean that items following the word are included, but items not specifically mentioned are not excluded. In addition, reference to an element by the indefinite article "a" or "an" does not exclude the possibility that more than one of the element is present, unless the context clearly requires that there is one and only one of the elements. The indefinite article "a" or "an" thus usually means "at least one".

The aliphatic polyol used in the present invention for preparing the polyhydrocarbyl esters preferably comprises 2-12 carbon atoms. The aliphatic polyol further preferably comprises 2-8 OH groups, more preferably 2-6 OH groups, even more preferably 2-4 OH groups, yet even more preferably 3-4 OH groups and in particular 4 OH groups. Consequently, the aliphatic polyol comprises diols, triols tetraols and the like. As will be appreciated by the person skilled in the art, one or more OH groups may be substituted by a masked OH group, e.g. an epoxide or oxiranyl group. Additionally, the aliphatic polyol may have exclusively primary OH groups, exclusively secondary OH groups or both primary and secondary OH groups.

The diols can, for example, be linear having the formula $HO(CH_2)_nOH$ wherein n=2-18. Examples this type of diol are 1,3-propanediol, 1,2-ethanediol, 1,4-butanediol, 1,5-pentanediol and 1,6-hexanediol. The diols may also have a branched structure. Examples of unbranched and branched diols are dimethylolpropane, neopentyl glycol, 2-propyl-2-methyl-1,3-propanediol, 2-butyl-2-ethyl-1,3-propanediol, 2,2-diethyl-1,3-propanediol, 1,2-propanediol, 1,3-butanediol, 2,2,4-trimethylpentane-1,3-diol, trimethylhexane-1,6-diol, 2-methyl-1,3-propanediol, diethylene glycol, triethylene glycol, dipropylene glycol and tripropylene glycol. The diols may also have a cyclic structure (i.e. cycloaliphatic diols), e.g. cyclohexane dimethanol and 1,3-dioxane-5,5-dimethanol.

The triols can have the general formula $R—C(CH_2OH)_3$, wherein R is a linear or branched alkyl group having 1-12 carbon atoms. Examples of suitable triols include trimethylolpropane, trimethylolethane, trimethylolbutane and 3,5,5-trimethyl-2,2-dihydroxymethylhexane-1-ol. A further type of suitable triols are those having two types of hydroxyl groups, i.e. primary as well as secondary hydroxyl groups, e.g. glycerol and 1,2,6-hexanetriol. Obviously, the triol may have a cycloaliphatic structure.

The aliphatic polyol may also be a tetraol, e.g. pentaerythritol, ditrimethylolpropane, diglycerol and ditrimethylolethane.

According to the invention, the aliphatic polyol is most preferably pentaerythritol.

Alternatively, the aliphatic polyol used in the present invention for preparing the polyhydrocarbyl esters may also be the reaction product of a dimeric fatty acid comprising 18-54 carbon atoms, preferably dimeric oleic acid and/or a, preferably saturated, preferably aliphatic, dicarboxylic acid, e.g. oxalic acid, adipic acid, azelaic acid and sebacic acid, comprising 2-50, preferably 2-12 carbon atoms and a polyol, wherein essentially each carboxylic acid group is esterified with one OH group of the polyol. This polyol is preferably aliphatic and is preferably selected from the group consisting of polyols comprising 2-12 carbon atoms, more preferably of polyols comprising 2-8 OH groups, more preferably 2-6 OH groups, even more preferably 2-4 OH groups, yet even more preferably 3-4 OH groups and in particular 4 OH groups. Consequently, this polyol may be a diol, a triol, a tetraol and the like as disclosed above. In particular, this polyol is pentaerythritol. The dimeric fatty acids and/or the dicarboxylic acids are used if higher viscosities are desired.

Obviously, the polyol may also be a mixture of the aliphatic polyol molecules described above. Additionally, the dimeric carboxylic acid or the dicarboxylic acid may be used in the form of an anhydride, acid halide and the like.

According to a preferred embodiment of the present invention, the polyhydrocarbyl ester of the aliphatic polyol is a tetrahydrocarbyl ester of pentaerythritol, wherein at least one hydrocarbyl group of the tetrahydrocarbyl ester comprises 6-14 carbon atoms.

According to the invention, it is preferred that pentaerythritol tetracaproate is excluded from the group of tetrahydrocarbyl esters of pentaerythritol according to the invention if all hydrocarbyl groups of the tetrahydrocarbyl ester comprise 6-14 carbon atoms and are all identical, and if these esters are used in the working of metals, especially hot rolling and cold rolling of metals, and in the casting of metals.

Additionally, according to this invention, two metal processing operations are discerned. One metal processing operation involves "metal working", i.e. a process wherein metals are shaped and formed. Examples of such processes include drawing, cold rolling and hot rolling. Another metal processing operation involves "metal removing", i.e. a process wherein metal is removed from a metal work piece. Examples of such processes include milling, cutting, turning, grinding and honing. In this description, the term "metal processing" is intended to encompass both "metal working" and "metal removing".

Accordingly, in a preferred embodiment of the present invention, the metal processing lubricant composition is a metal working lubricant composition comprising a tetrahydrocarbyl ester of pentaerythritol, wherein at least one hydrocarbyl group comprises 6-14 carbon atoms, provided that the tetrahydrocarbyl ester of pentaerythritol is not pentaerythritol tetracaproate. In another preferred embodiment of the present invention, the metal processing lubricant composition is a metal removing lubricant composition comprising a tetrahydrocarbyl ester of pentaerythritol, wherein at least one hydrocarbyl group comprises 6-14 carbon atoms. According to the present invention, it is preferred that the at least one hydrocarbyl group comprises 6-12 carbon atoms, more preferably 6-10 carbon atoms. Preferably, the at least one hydrocarbyl group comprises at least 8 carbon atoms.

In the tetrahydrocarbyl ester of pentaerythritol according to the present invention, the hydrocarbyl groups other than the hydrocarbyl group comprising 6-14 carbon atoms may be selected from a wide variety of hydrocarbyl groups, e.g. saturated, mono-unsaturated and poly-unsaturated. If unsaturated hydrocarbyl groups are present, they may contain one or more ethenylene and/or ethynylene moieties.

However, according to the invention, it is preferred that the majority of the hydrocarbyl groups are saturated hydrocarbyl groups, wherein the term "majority" means that at least 60% of the hydrocarbyl groups, based on the total weight of the tetrahydrocarbyl ester of pentaerythritol, are saturated hydrocarbyl groups. More preferably, at least 85 wt % and most preferably at least 90 wt % of the hydrocarbyl groups are saturated hydrocarbyl groups. The degree of saturation of the tetrahydrocarbyl esters according to the present invention is, as is common in the art, expressed by the iodine value as is discussed below. A high degree of saturation is beneficial since it provides a high oxidation and corrosion stability to the tetrahydrocarbyl ester of pentaerythritol according to the present invention. The hydrocarbyl groups may obviously be linear or branched. Examples of saturated hydrocarbyl groups include n-hexyl, n-heptyl, n-octyl, n-nonyl, n-decyl, n-undecyl, n-dodecyl, n-tridecyl, n-tetradecyl, n-pentadecyl, n-hexadecyl, n-heptadecyl, n-octadecyl, n-nonadecyl, n-eicosyl, i-hexyl, i-heptyl, i-octyl, i-nonyl, i-decyl, i-undecyl, i-dodecyl, i-tridecyl, i-tetradecyl, i-pentadecyl, i-hexadecyl, i-heptadecyl, i-octadecyl, i-nonadecyl and i-eicosyl.

The polyhydrocarbyl esters according to the invention and the tetrahydrocarbyl esters of pentaerythritol according to the preferred embodiment of the present invention are prepared by methods well known in the art, i.e. by an esterification of pentaerythritol with a fatty acid composition comprising at least 25 mol % of a $C_6$-$C_{14}$ fatty acid, based on the total weight of the fatty acid composition, optionally in the presence of a suitable catalyst. Preferably, the fatty acid composition comprises 25-100 mol % of a $C_6$-$C_{14}$ fatty acid and 0-75 mol % of a $C_6$-$C_{20}$ fatty acid, based on the total weight of the fatty acid composition. Optionally, during the esterification reaction, water is removed, optionally azeotropically. The polyhydrocarbyl esters according to the invention and the tetrahydrocarbyl esters of pentaerythritol according to the preferred embodiment of the present invention may also be prepared by transesterification, wherein a (partial) ester of the polyol or pentaerythritol is reacted with a fatty acid composition comprising at least 25 mol % of a $C_6$-$C_{14}$ fatty acid, based on the total weight of the fatty acid composition, optionally in the presence of a suitable catalyst. Optionally, in these esterification of transesterification eactions, dimeric fatty acids and/or the dicarboxylic acids may be used as additional reagents if higher viscosities are desired, preferably in an amount of 0.01-0.25 mol per mol polyol.

According to the present invention, it is preferred that the polyhydrocarbyl ester of the aliphatic polyol and the tetrahydrocarbyl ester of pentaerythritol comprise more than one hydrocarbyl groups comprising 6-14 carbon atoms. More in particular, it is preferred that the molar equivalent of hydrocarbyl groups having 6-14 carbon atoms per mol pentaerythritol in the tetrahydrocarbyl ester is between 1.5 to 4.0, more preferably 1.6 to 4.0, even more preferably 1.7 to 4.0. This implies that the polyhydrocarbyl esters of the aliphatic polyol and the tetrahydrocarbyl esters of pentaerythritol according to the present invention may be prepared from the polyol and pentaerythritol, respectively, and a fatty acid composition comprising a blend of fatty acid feed stocks. Alternatively, the polyhydrocarbyl esters and the tetrahydrocarbyl esters may be prepared from a single source of fatty acids, e.g. coconut oil, or even from a single fatty acid, e.g. tetradecanoic, dodecanoic or decanoic acid.

According to the present invention, the other hydrocarbyl groups, i.e. the hydrocarbyl groups that are not a hydrocarbyl groups having 6-14 carbon atoms, comprise 6-20 carbon atoms, preferably 6-18 carbon atoms. Also in this case it is preferred that the majority of these other hydrocarbyl groups are saturated, i.e. at least 70 wt. % of these hydrocarbyl groups, based on the total weight of the polyhydrocarbyl ester of the polyol or of the tetrahydrocarbyl ester of pentaerythritol, more preferably at least 85 wt % and most preferably at least 90 wt %. Consequently, the tetrahydrocarbyl ester according to the present invention may comprise molecules having the general formula $C[CH_2—O—C(O)—C_8H_{17}][CH_2—O—C(O)—C_{16}H_{33}]_3$. These other hydrocarbyl groups comprise most preferably at least 8 carbon atoms.

As will be apparent to those skilled in the art, the metal processing lubricant composition according to the present invention may comprise a blend of two or more different polyhydrocarbyl esters of the polyol and/or the tetrahydrocarbyl esters of pentaerythritol.

The metal processing lubricant composition according to the present invention preferably comprises polyhydrocarbyl esters of the aliphatic polyol, preferably tetrahydrocarbyl esters of pentaerythritol, having a kinematic viscosity (40° C.) according to ASTM D 445 of 20 to 100 cSt., more preferably of 25 to 80 cSt. and most preferably of 35 to 55 cSt. Additionally, the polyhydrocarbyl esters of the aliphatic polyol, preferably the tetrahydrocarbyl esters of pentaerythritol, have a pour point according to test method ASTM D 97 below 30° C., more preferably below 15° C. and most preferably below 10° C. Furthermore, the tetrahydrocarbyl esters of pentaerythritol, have an iodine value according to test method APAG FA-015-1992 of less than 60 g $I_2$/100 g tetrahydrocarbyl ester, more preferably less than 30 g $I_2$/100 g tetrahydrocarbyl ester and most preferably less than 10 g $I_2$/100 g tetrahydrocarbyl ester.

According to the present invention, the metal processing lubricant composition may comprise the polyhydrocarbyl ester of the aliphatic polyol and/or the tetrahydrocarbyl ester of pentaerythritol as the major component, i.e. in an amount of 50-100 wt %, preferably 70 to 100 wt %, more preferably 80 to 100 wt %, based on the total weight of the metal processing lubricant composition, wherein the remainder of the metal processing lubricant composition comprises additives such as extreme pressure additives, anti-wear additives, pour point depressants, anti-oxidants, other lubricating components and the like. Alternatively, the metal processing lubricant composition may be in the form of an emulsion or an aqueous dispersion, wherein said emulsion or aqueous dispersion comprises the tetrahydrocarbyl ester of pentaerythritol according to the present invention in an amount of 0.025-30 wt %, preferably 0.1 to 10 wt %, more preferably 0.5 to 5 wt %, based on the total weight of the emulsion or aqueous dispersion.

As already disclosed above, the metal processing lubricant composition according to the present invention preferably comprises one or more additives, in particular an extreme pressure additive and/or an anti-wear additive.

The present invention further relates to the use of a polyhydrocarbyl ester of the aliphatic polyol, preferably the tetrahydrocarbyl ester of pentaerythritol, in metal processing operations, wherein at least one hydrocarbyl group of the tetrahydrocarbyl ester comprises 6-14 carbon atoms. In this respect it is preferred that pentaerythritol tetracaproate is excluded from the group of tetrahydrocarbyl esters of pentaerythritol according to the invention if all hydrocarbyl groups of the tetrahydrocarbyl ester comprise 6-14 carbon atoms and are all identical, and if these esters are used in the working of metals, especially hot rolling and cold rolling of metals, and in the casting of metals.

According to a preferred embodiment of the present invention, the metal processing operation comprises a metal forming operation, a metal removing operation or both. Additionally, it is preferred that the metal forming operation comprises a cold rolling operation, a hot rolling operation or a drawing operation. Furthermore, it is preferred that the metal removing operation is selected from the group consisting of grinding, milling, cutting, turning and honing.

EXAMPLES

Example 1

The following tetrahydrocarbyl esters of pentaerythritol were prepared from fatty acid feed stocks and pentaerythritol in amounts indicated in Table 1. Product properties are listed in Table 2. The esterification was performed in the presence of a catalyst well-known to those skilled in the art. Conversion was always about 100%. Residual amounts of acid and alcohol are indicated with resp. Acid Number and Hydroxyl Value as shown in Table 2. "About 100%" means "very low residuals according to industrial standards".

Acid number according to ASTM D 974 (mg KOH/g)
Saponification number according to ASTM D 94 (mg KOH/g)
Viscosity according ro ASTM D 445 (40° C., cSt)
OH value according to AOCS CD-13-60 (1989)
Iodine value according to APAG FA-015-1992
Density according to ASTM D 1298 (g/cm$^3$ at 25° C.)
Pour point according to ASTM D 97 (° C.)

TABLE 1

| Reaction component | Amount[a] (mol) | Amount (gram) | Reaction component | Amount[a] (mol) | Amount (gram) | Reaction component | Amount[a] (mol) | Amount (gram) |
|---|---|---|---|---|---|---|---|---|
| | | | Product | | | | | |
| Coconut Oil FA | 2.0 | 50.0 | Coconut Oil FA | 0.4 | 9.7 | Coconut Oil FA | 2.9 | 62.0 |
| Palm Oil FA | — | — | Palm Oil FA | 1.3 | 40.4 | Palm Oil FA | — | — |
| $C_8$-$C_{10}$ FA | 1.7 | 33.3 | $C_8$-$C_{10}$ FA | 1.9 | 34.1 | $C_8$-$C_{10}$ FA | — | — |
| Oleic acid | — | — | Oleic acid | — | — | Oleic acid | 0.7 | 21.4 |
| Pentaerythritol | 4.0 | 16.7 | Pentaerythritol | 4.0 | 15.8 | Pentaerythritol | 4.0 | 14.6 |
| Dimeric acid | — | — | Dimeric acid | — | — | Dimeric acid | 0.1 | 2.0 |
| Total | | 100 | | | 100 | | | 100 |

[a]Calculated. MW Coconut oil FA 200.31; MW Palm Oil FA 270.00; MW C8-C10 FA 158.23; MW Oleic acid 282.45; MW Pentaerythritol 136.15; MW Dimeric acid 565.00.

TABLE 2

| Product properties | PPE-1 | PPE-2 | PPE-3 |
|---|---|---|---|
| Viscosity (40° C.) (cSt) | 44 | 52 | 70 |
| OH value (mg KOH/g) | 13 | 12 | 16 |
| $I_2$ value (g $I_2$/100 g) | 7 | 24 | 40 |
| Average MW (g) | 744 | 787 | 863 |
| Acid number | 7.1 | 5.8 | 6.1 |
| Saponification number | 274 | 256 | 225 |
| OH value | 13 | 12 | 16 |

TABLE 2-continued

| Product properties | PPE-1 | PPE-2 | PPE-3 |
|---|---|---|---|
| Density | 0.94 | 0.95 | 0.93 |
| Pour point | 6 | 12 | 9 |

The invention claimed is:

1. A metal processing lubricant composition comprising a polyhydrocarbyl ester of an aliphatic polyol, wherein at least one hydrocarbyl group of the polyhydrocarbyl ester comprises 6-14 carbon atoms, other hydrocarbyl groups of the polyhydrocarbyl ester comprise 6-20 carbon atoms, the polyhydrocarbyl ester has a kinematic viscosity (40° C.) of 20-100 cSt, a molar equivalent of hydrocarbyl groups having 6-14 carbon atoms per mol aliphatic polyol in the polyhydrocarbyl ester is between 1.5 to 4.0, and wherein the aliphatic polyol comprises 2-12 OH groups and 2-12 carbon atoms.

2. The metal processing lubricant composition according to claim 1, wherein the aliphatic polyol comprises 2-8 OH groups.

3. The metal processing lubricant composition according to claim 1, wherein the aliphatic polyol comprises 2-6 OH groups.

4. The metal processing lubricant composition according to claim 1, wherein the aliphatic polyol comprises 2-4 OH groups.

5. The metal processing lubricant composition according to claim 1, wherein the aliphatic polyol comprises 3-4 OH groups.

6. The metal processing lubricant composition according to claim 1, wherein the molar equivalent of hydrocarbyl groups having 6-14 carbon atoms per mol aliphatic polyol in the polyhydrocarbyl ester is 1.6 to 4.0.

7. The metal processing lubricant composition according to claim 1, wherein the molar equivalent of hydrocarbyl groups having 6-14 carbon atoms per mol aliphatic polyol in the polyhydrocarbyl ester is 1.7 to 4.0.

8. The metal processing lubricant composition according to claim 1, wherein the polyhydrocarbyl ester comprises a dimeric fatty acid comprising 18-54 carbon atoms and/or a dicarboxylic acid comprising 2-50 carbon atoms.

9. The metal processing lubricant composition according to claim 1, wherein the metal processing lubricant composition comprises a blend of two or more polyhydrocarbyl esters.

10. The metal processing lubricant composition according to claim 1, wherein at least 70 wt. % of the hydrocarbyl groups are saturated hydrocarbyl groups, based on the total weight of the polyhydrocarbyl ester.

11. The metal processing lubricant composition according to claim 1, wherein the polyhydrocarbyl ester has a pour point according to ASTM D97 of not more than 30° C.

12. The metal processing lubricant composition according to claim 1, wherein the polyhydrocarbyl ester has an iodine value of less than 60 $gJ_2/100$ g.

13. The metal processing lubricant composition according to claim 1 in a form of an emulsion or an aqueous dispersion.

14. The metal processing lubricant composition according to claim 1, further comprising an extreme pressure additive.

15. The metal processing lubricant composition according to claim 1, further comprising an anti-wear additive.

16. A method of metal processing, comprising applying a lubricant composition to a metal, wherein the lubricant composition comprises a polyhydrocarbyl ester of an aliphatic polyol, wherein at least one hydrocarbyl group of the polyhydrocarbyl ester comprises 6-14 carbon atoms, other hydrocarbyl groups of the polyhydrocarbyl ester comprise 6-20 carbon atoms, the polyhydrocarbyl ester has a kinematic viscosity (40° C.) of 20-100 cSt, a molar equivalent of hydrocarbyl groups having 6-14 carbon atoms per mol aliphatic polyol in the polyhydrocarbyl ester being between 1.5 to 4.0, and wherein the aliphatic polyol comprises 2-12 OH groups and 2-12 carbon atoms.

17. The method according to claim 16, wherein the metal processing comprises a metal forming operation, a metal removing operation or both.

18. The method according to claim 17, wherein the metal forming operation comprises a cold rolling operation, a hot rolling operation or a drawing operation.

19. The method according to claim 17, wherein the metal removing operation is selected from the group consisting of grinding, milling, cutting, turning and honing.

* * * * *